US006084339A

United States Patent [19]

Xie et al.

[11] Patent Number: 6,084,339

[45] Date of Patent: Jul. 4, 2000

[54] FIELD EMISSION DEVICE HAVING AN ELECTROPLATED STRUCTURE AND METHOD FOR THE FABRICATION THEREOF

[75] Inventors: Chenggang Xie, Phoenix; Rodolfo Lucero, Scottsdale; Johann Trujillo, Mesa, all of Ariz.

[73] Assignee: Motorola, Inc., Schaumburg, Ill.

[21] Appl. No.: 09/053,436

[22] Filed: Apr. 1, 1998

[51] Int. Cl.[7] ..... H01J 31/12

[52] U.S. Cl. ..... 313/310; 313/497; 313/309; 313/336; 313/351; 313/495

[58] Field of Search ..... 313/310, 495, 313/496, 497, 309, 336, 351, 346 R

[56] References Cited

U.S. PATENT DOCUMENTS 3,755,704 8/1973 Spindt et al. ..... 313/309
5,528,103 6/1996 Spindt et al. .
5,725,787 3/1998 Curtin et al. ..... 313/496
5,742,117 4/1998 Spindt et al. ..... 313/495
5,789,857 8/1998 Yamaura et al. ..... 313/495

*Primary Examiner*—Ashok Patel
*Attorney, Agent, or Firm*—Kathleen A. Tobin; Kevin D. Wills

[57] ABSTRACT

A field emission device (100) includes an electroplated structure (122) and an electron emitter (118). Electroplated structure (122) includes a base (124), which is disposed proximate to electron emitter (118) and is made from the same material from which electron emitter (118) is made. Electroplated structure (122) further includes an electroplating electrode (126), which is disposed on base (124), and an electroplated layer (128), which is disposed on electroplating electrode (126). A method for fabricating field emission device (100) includes a step of forming electron emitter (118) and further includes a step of forming base (124) during the step of forming electron emitter (118). The method further includes a step of completely encapsulating electron emitter (118) prior to a step of forming electroplated layer (128).

10 Claims, 4 Drawing Sheets

FIELD EMISSION DEVICE HAVING AN ELECTROPLATED STRUCTURE AND METHOD FOR THE FABRICATION THEREOF

FIELD OF THE INVENTION

The present invention pertains to the area of field emission devices (FEDs) and, more particularly, to methods for electroplating structures in FEDs.

BACKGROUND OF THE INVENTION

It is known in the art to provide focusing electrodes as part of a cathode plate of an FED. The focusing electrodes are useful for collimating electron beams generated by electron emitters, which can include emitters known as Spindt tips.

In one prior art method, the focusing electrodes are formed by vapor deposition methods. It is also known to use an electroplating method to provide focusing electrodes in an FED. For example, in U.S. Pat. No. 5,528,103, Spindt, et al. describe forming focusing ridges by electroplating onto a metal layer. Spindt, et al. teach that the metal layer is deposited on a dielectric layer that defines electron emitter wells. Spindt, et al. further teach that the metal layer is made from the material from which the gate lines are formed. During the electroplating step of this prior art method, the gate lines are protected by using a photoresist mask. However, the electron emitters may be damaged during electroplating steps if they are not adequately protected.

Accordingly, there exists a need for an improved FED having electroplated structures, and a method for fabrication that protects the electron emitters from damage during the electroplating process.

Figure 1:
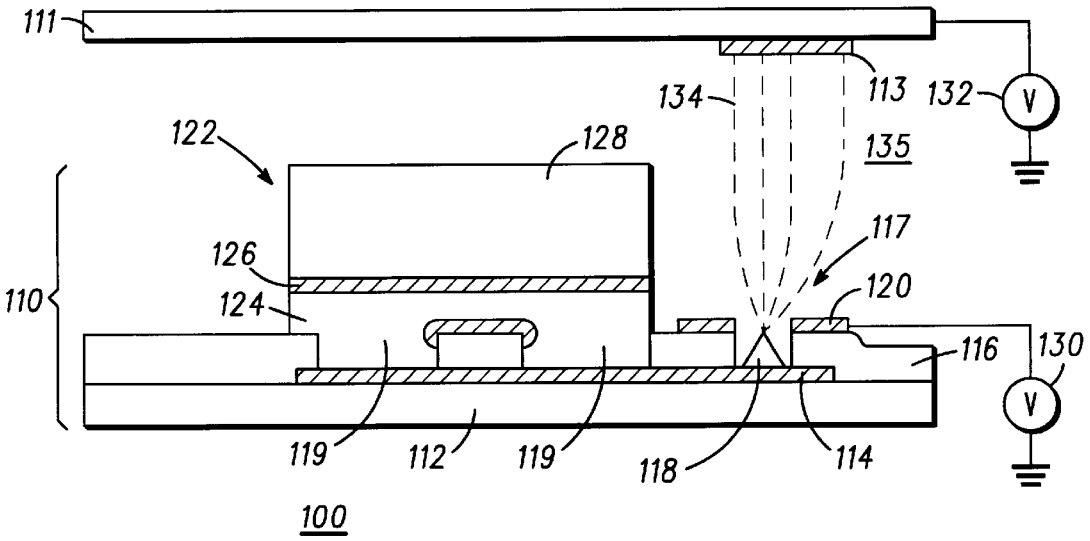
FIG. 1 is a cross-sectional view of an FED having an electroplated structure in accordance with a preferred embodiment of the invention.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENTS

The invention is for an FED having an electroplated structure positioned adjacent to an electron emitter. The electroplated structure includes a base, and an electroplated layer that is positioned on the base. The base is made from the same material from which the electron emitter is made.

Preferably, the base is further connected to a base electrode, which is useful for applying a potential to the electroplated layer. The electroplated layer can thus be employed as a focusing electrode for focusing an emitted electron beam. The electroplated layer can also be employed as a spacer pad upon which a spacer is placed. The spacer pad offers, among other things, structural compliance.

A method for fabricating an FED in accordance with the invention provides protection of the electron emitter during the steps for making the electroplated layer. The method of the invention includes the step of encapsulating the electron emitter prior to the step of forming the electroplated layer. The encapsulation is removed subsequent to the formation of the electroplated layer.

Referring now to FIG. 1, there is depicted a cross-sectional view of an FED 100 having an electroplated structure 122 in accordance with a preferred embodiment of the invention. In the embodiment of FIG. 1, electroplated structure 122 includes an electroplated layer 128, which is used as a focusing electrode to focus an emitted electron beam 134. Emitted electron beam 134 is represented by dashed lines in FIG. 1. In the embodiment of FIG. 1, the focusing potential at electroplated structure 122 is provided by a cathode 114.

Field emission device 100 includes a cathode plate 110 and an anode 111, which is spaced apart from cathode plate 110 to define an interspace region 135. Interspace region 135 has a pressure of less than about $1.33\times10^{-4}$ Pascal.

Cathode plate 110 includes a substrate 112, which can be made from glass, quart, silicon, and the like. Cathode plate 110 further includes cathode 114, which is disposed on substrate 112. Cathode 114 includes a layer of conductive material, such as molybdenum, niobium, and the like. Cathode plate 110 further includes a dielectric layer 116, which is formed on cathode 114.

Dielectric layer 116 defines two types of well structures. The first type of well structure is an emitter well 117. An electron emitter 118 is disposed within each emitter well 117. Electron emitter 118 is connected to cathode 114. For simplicity and ease of understanding, the figures only illustrate one emitter well 117. However, any number of emitter wells can be employed. The second type of well structure is a base well 119.

Cathode plate 110 further includes electroplated structure 122, which is positioned adjacent electron emitter 118. Electroplated structure 122 includes a base 124, an electroplating electrode 126, and electroplated layer 128. In the embodiment of FIG. 1, base 124 is partially disposed within base wells 119 and is connected to cathode 114.

Base 124 is made from the same emissive material from which electron emitter 118 is made. The emissive material can include molybdenum, silicon, and the like. Preferably, the emissive material is molybdenum.

Base wells 119 provide several benefits. First, they allow electrical contact between electroplated structure 122 and cathode 114. Also, they enable base 124 to remain fixed during a lift-off step, which is described herein with reference to the method of the invention.

Electroplating electrode 126 is disposed on base 124. The selection of a material for electroplating electrode 126 is based upon the material selected for electroplated layer 128. For example, if electroplated layer 128 is made from nickel or copper, electroplating electrode 126 can include a first layer made from titanium, which is deposited on base 124, and a second layer made from copper, which is deposited on the first layer. An additional layer of titanium can also be formed on the copper layer. As a further example, if electroplated layer 128 is made from gold, electroplating electrode 126 can include a first layer made from chrome, which is deposited upon base 124, and a second layer made from gold or nickel, which is deposited on the first layer.

Electroplated layer 128 is disposed on electroplating electrode 126 and is made from a conductive material that can be deposited by electroplating. Preferably, electroplated layer 128 is made from nickel.

In the embodiment of FIG. 1, electroplated structure 122 has a height above dielectric layer 116, which is selected to enhance collimation of emitted electron beam 134. An exemplary configuration of field emission device 100 includes a distance between electron emitter 118 and anode 111 equal to about one millimeter and further includes a height of electroplated structure 122 above dielectric layer 116 equal to about 30 micrometers. The scope of the invention is not limited by this exemplary configuration.

Cathode plate 110 further includes a gate electrode 120, which is formed on dielectric layer 116 and adjacent to emitter well 117. Gate electrode 120 is spaced apart from electroplated structure 122 and is connected to a voltage source 130. Voltage source 130 is useful for providing a potential at gate electrode 120 for causing electron emission from electron emitter 118. Cathode 114 is also connected to a voltage source (not shown) for providing a potential at cathode 114 for causing electron emission from electron emitter 118. A voltage source 132 is connected to anode 111 for attracting emitted electron beam 134 toward anode 111.

In the embodiment of FIG. 1, FED 100 further includes a phosphor 113, which is disposed on anode 111. Phosphor 113 emits light upon excitation by the electrons of emitted electron beam 134. In the embodiment of FIG. 1, electroplated structure 122 is used to focus emitted electron beam 134 to confine emitted electron beam 134 to receipt at phosphor 113. The focusing provided by electroplated structure 122 provides the benefits of improved efficiency and color purity of FED 100.

Figure 2:
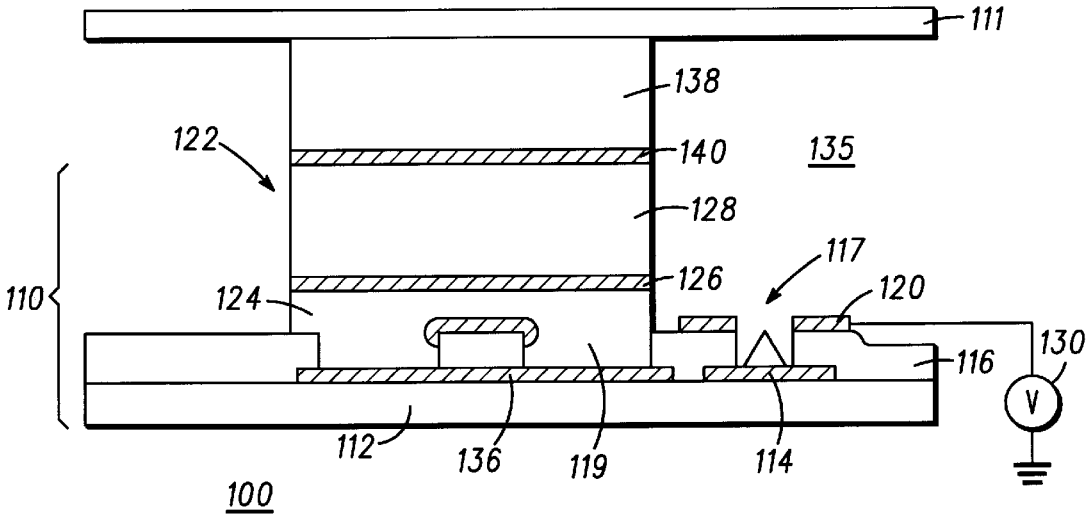
FIG. 2 is a cross-sectional view of an FED having an electroplated structure in accordance with another embodiment of the invention.

FIG. 2 illustrates, in cross-section, FED 100 having electroplated structure 122 in accordance with another embodiment of the invention. In the embodiment of FIG. 2, electroplated structure 122 is used as a spacer pad for mechanically supporting a spacer 138. Also in the embodiment of FIG. 2, the potential at electroplated structure 122 is provided by a base electrode 136. The potential at base electrode 136 can be controlled independently from the potential at cathode 114.

Spacer 138 extends between electroplated structure 122 and anode 111. Spacer 138 is made from hard material and is useful for maintaining the separation between anode 111 and cathode plate 110. Spacer 138 can be made from a dielectric material, a bulk resistive material, and the like.

In the embodiment of FIG. 2, FED 100 further includes base electrode 136, which is disposed on substrate 112. Base electrode 136 is electrically isolated from cathode 114 and is connected to base 124 of electroplated structure 122. Base electrode 136 is connected to a voltage source (not shown) and is useful for applying an independently controllable potential to electroplated structure 122.

In the embodiment of FIG. 2, field emission device 100 further includes a bonding layer 140 interposed between spacer 138 and electroplated layer 128. Bonding layer 140 is useful for affixing spacer 138 to electroplated structure 122. Bonding layer 140 includes a thin layer of metal, which is selected to form a bond to electroplated layer 128. For example, bonding layer 140 can include a layer of gold. As a further example, bonding layer 140 can include a first layer of chrome, which is affixed to spacer 138, and a second layer of aluminum, which is affixed to the first layer. Bonding layer 140 is attached to electroplated layer 128 by a convenient bonding method, such as thermal compression bonding.

FIGS. 3–14 illustrate, in cross-section, cathode plate 110 of the preferred embodiment of FED 100 at various process steps in accordance with the method of the invention. In accordance with the method of the invention, base 124 of electroplated structure 122 is formed during the deposition of the emissive material, which is used to form electron emitter 118.

During the formation of electron emitter 118, electron emitter 118 becomes encapsulated. When electron emitter 118 is encapsulated, emitter well 117 is completely enclosed, so that electron emitter 118 cannot be acted upon by the agents of subsequent processing steps. In accordance with the method of the invention, the encapsulation is retained throughout the subsequent steps for forming electroplated structure 122. The encapsulation protects electron emitter 118 from adverse interactions arising from the electroplating steps.

Figure 3:
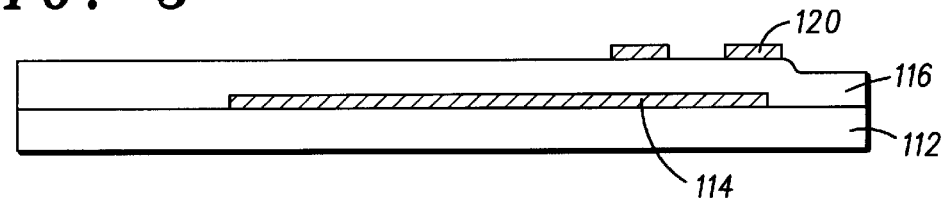
FIGS. 3–14 are cross-sectional views of the cathode plate of the preferred embodiment of an FED at various process steps in accordance with the method of the invention.

As illustrated in FIG. 3, the fabrication of FED 100 includes forming cathode 114 on substrate 112. Cathode 114 can be made by vapor deposition of a metal. After the formation of cathode 114, a dielectric material is deposited upon cathode 114 to provide dielectric layer 116. Dielectric layer 116 is made from a dielectric material, such as silicon dioxide, silicon nitride, and the like.

After the step of depositing the dielectric material, gate electrode 120 is formed on dielectric layer 116. Gate electrode 120 can be made by vapor deposition of a metal, such as molybdenum, niobium, and the like.

Figure 4:
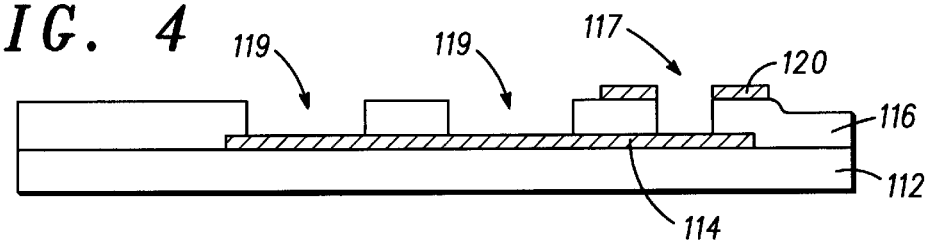

Thereafter, as illustrated in FIG. 4, emitter well 117 and base wells 119 are formed in dielectric layer 116. Emitter well 117 and base wells 119 are formed by using convenient etching and patterning techniques.

After the step of patterning dielectric layer 116, a lift-off layer 144 is formed on gate electrode 120. In the particular example of FIG. 5, lift-off layer 144 is a thin layer of aluminum, which is deposited using a low-angle vapor deposition technique, as indicated by arrows 142 in FIG. 5.

The low-angle vapor deposition technique includes the introduction of gaseous aluminum at a deposition angle with respect to the plane defined by dielectric layer 116. The deposition angle is selected to prevent deposition of the lift-off material, which is represented by arrows 142 in FIG. 5, onto the bottom surface of emitter well 117. During the aluminum deposition, substrate 112 is rotated about a central axis, which is perpendicular to substrate 112.

During the low-angle vapor deposition of the lift-off material, the lift-off material also coats surfaces of dielectric layer 116. In accordance with the method of the invention, the lift-off material does not coat a bottom surface 145 of each of base wells 119.

If a plurality of base wells are employed, base wells at the interior of base 124 can have bottom surfaces coated with the lift-off material. However, coating of the bottom surfaces is prevented in the base wells that are in contact with lift-off material that is subsequently removed.

Figure 5:
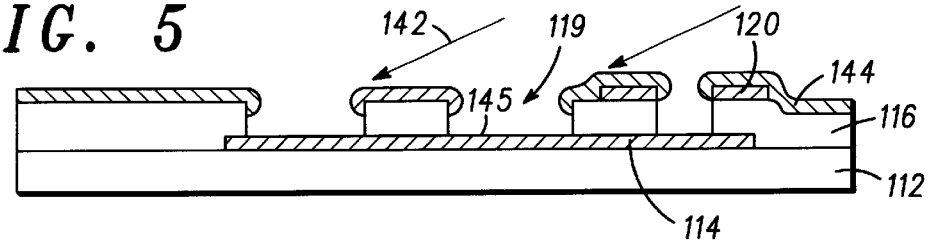

Given the deposition angle of the low-angle vapor deposition, the dimensions of base wells 119 are selected to preclude the formation of a lift-off coating at bottom surfaces 145 of base wells 119. In the example of FIG. 5, the opening of base wells 119 is circular. The diameter of the opening has an upper limit, above which deposition at bottom surface 145 occurs. Thus, the diameter of base wells 119 is selected to be below this upper limit. Deposition at the bottom surfaces can also be prevented by manipulation of the depth of the base wells. For example, given a deposition angle of ten degrees and a depth of base wells 119 of one micrometer, the maximum diameter of base wells 119 is about 5.7 micrometers.

Figure 6:
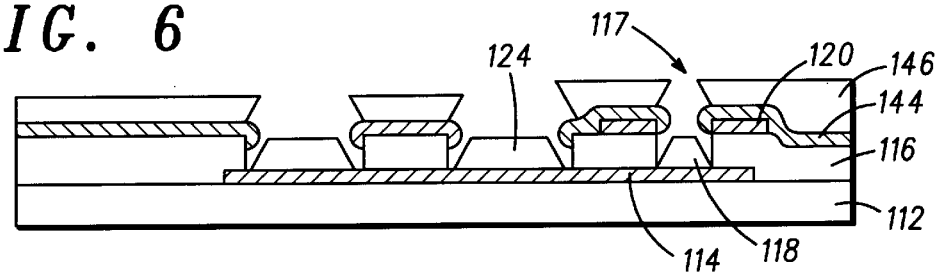
Figure 7:
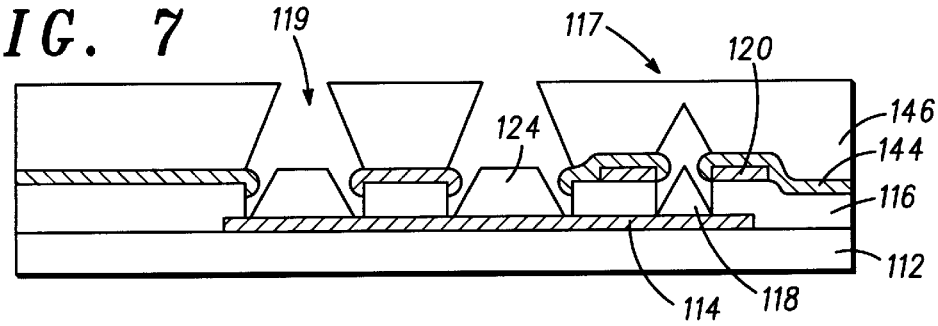

Subsequent to the formation of lift-off layer 144, electron emitter 118 is formed, as illustrated in FIGS. 6 and 7. Electron emitter 118 is formed using a collimated vapor deposition of an emissive material, as described with reference to FIG. 1. During the collimated vapor deposition, emissive material is deposited within emitter well 117, within base wells 119, and on lift-off layer 144. The emissive material within base wells 119 and on lift-off layer 144 constitute a emitter material layer 146. Due to the collimated nature of the vapor deposition, the size of the openings, which are defined by emitter material layer 146 and which overlie emitter well 117 and base wells 119, are progressively reduced during the course of the deposition.

In accordance with the invention, the opening of the base well is larger than the opening of the emitter well. In the embodiment of FIG. 7, the diameter of base well 119 is greater than the diameter of emitter well 117. An exemplary configuration includes emitter well 117 having a diameter that is equal to the depth of emitter well 117 and further includes base well 119 having a diameter equal to three times the diameter of emitter well 117. This exemplary configuration does not limit the scope of the invention.

Because the diameter of each of base wells 119 is greater than the diameter of emitter well 117, the opening defined by emitter material layer 146, which overlies emitter well 117, becomes closed off before the opening that overlies each of base wells 119 becomes closed off. In FIG. 7 the opening overlying emitter well 117 has become closed off, while the opening above each of base wells 119 is not closed off. Further depicted in FIG. 7 is the configuration wherein electron emitter 118 is encapsulated by emitter material layer 146.

Figure 8:
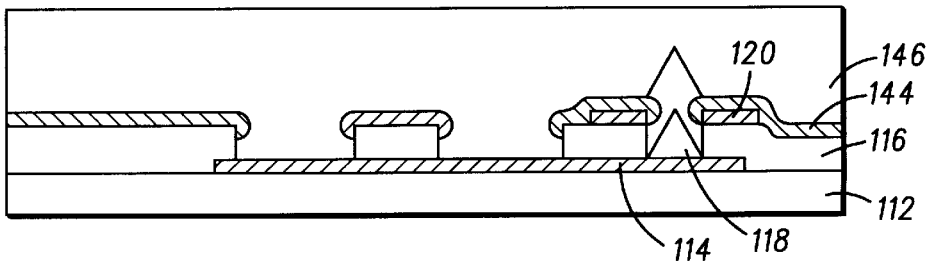

Preferably, after electron emitter 118 has become encapsulated, the collimated vapor deposition of the emissive material is terminated, and an uncollimated vapor deposition of the emissive material is commenced. During the collimated vapor deposition, gaps are formed within base wells 119. The gaps are defined by dielectric layer 116 and the portions of emitter material layer 146 that are disposed within base wells 119. The uncollimated vapor deposition facilitates the removal, or filling, of these gaps. The uncollimated vapor deposition is continued until the opening that overlies each of base wells 119 becomes closed off, as illustrated in FIG. 8.

Figure 9:
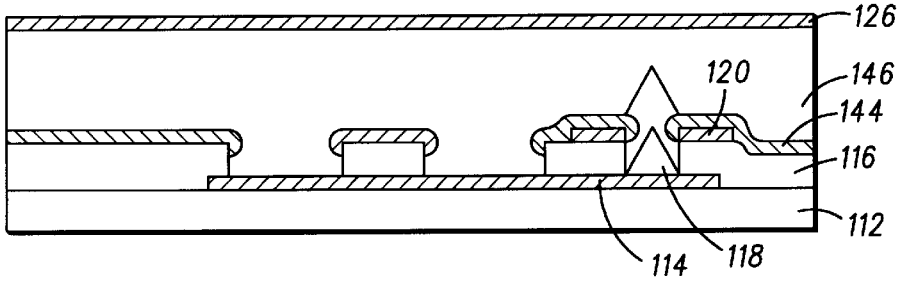

Thereafter, as illustrated in FIG. 9, electroplating electrode 126 is formed on emitter material layer 146. Electroplating electrode 126 is deposited using one or more convenient deposition techniques. The materials of electroplating electrode 126 are described above with reference to FIG. 1.

Figure 10:
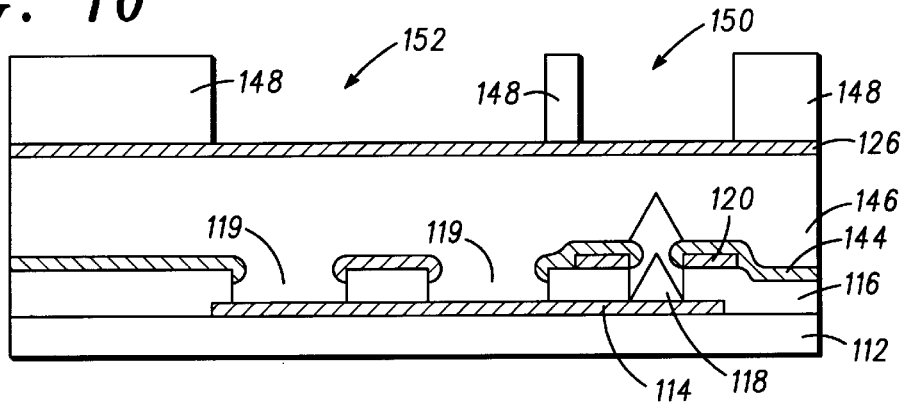
Figure 11:
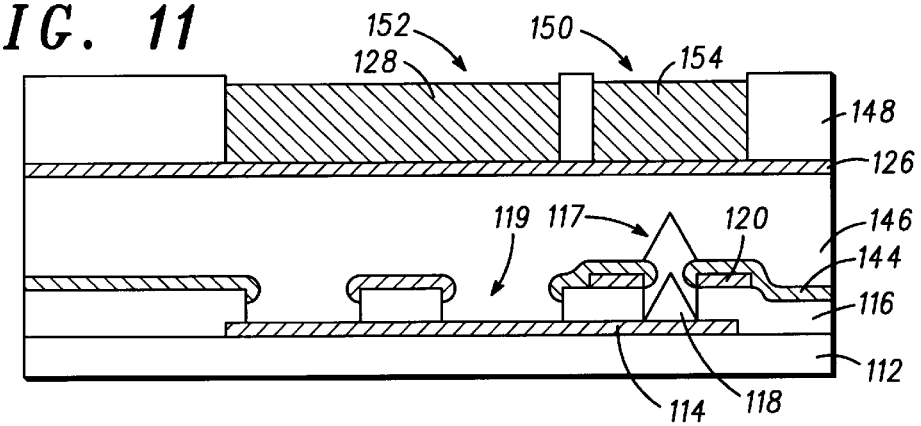
Figure 12:
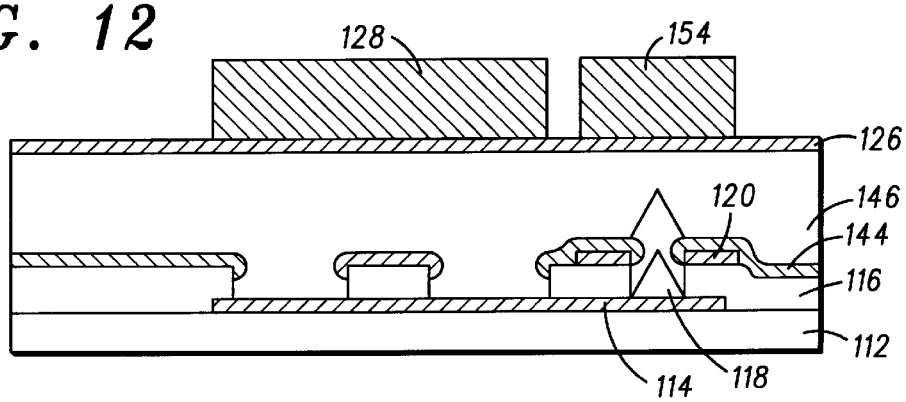

After the formation of electroplating electrode 126, a mask 148 is formed on electroplating electrode 126. Mask 148 can include a photoresist. Mask 148 further defines a first well 150 and a second well 152, as depicted in FIG. 10.

Subsequent to the formation of mask 148, a conductive material, such as nickel, gold, copper, and the like, is electroplated onto electroplating electrode 126. The step of electroplating includes the steps of applying a potential to electroplating electrode 126 and thereafter introducing a plating solution, which includes the conductive material. The potential applied to electroplating electrode 126 is selected to cause plating onto electroplating electrode 126 of the conductive material, to form the structure depicted in FIG. 11.

The step of electroplating results in the formation of a masking layer 154 within first well 150 and electroplated layer 128 within second well 152. Masking layer 154 overlies electron emitter 118, and electroplated layer 128 overlies base wells 119 and is adjacent to masking layer 154. After the step of electroplating a conductive material onto electroplating electrode 126, mask 148 is removed, thus realizing the structure of FIG. 12.

Figure 13:
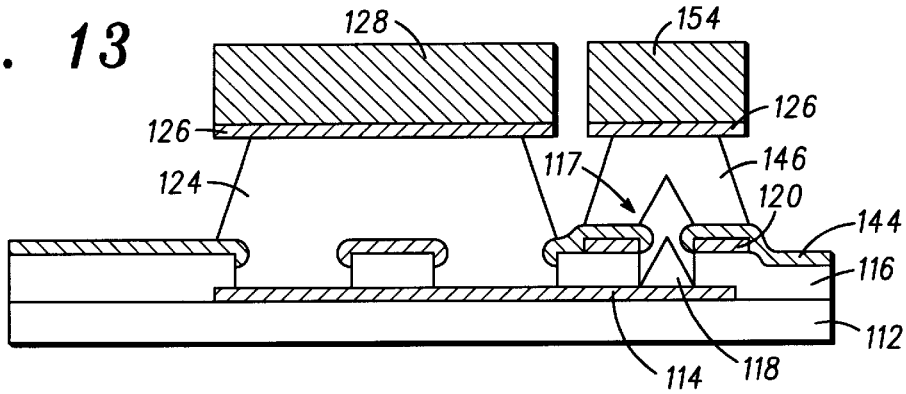

Subsequent to the step of removing mask 148, electroplating electrode 126 and emitter material layer 146 are selectively etched to form the structure depicted in FIG. 13. In accordance with the method of the invention, the selective etch is performed to expose lift-off layer 144 while also maintaining the encapsulation of electron emitter 118 by emitter material layer 146. The dimensions of masking layer 154 are selected to ensure the maintenance of the encapsulation of electron emitter 118 during the selective etch step.

Figure 14:
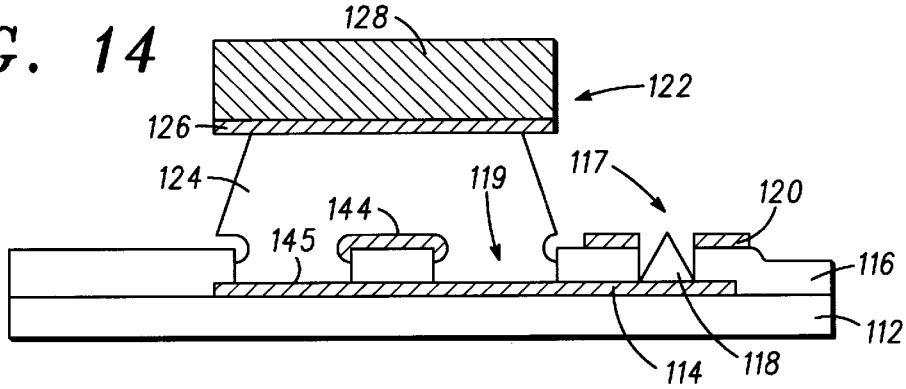

After the step of selectively etching electroplating electrode 126 and emitter material layer 146, lift-off layer 144 is removed to realize the structure depicted in FIG. 14. The removal of lift-off layer 144 results in electron emitter 118 no longer being encapsulated. Because lift-off layer 144 does not coat bottom surfaces 145 of base wells 119, base 124 is not removed during the removal of lift-off layer 144.

Figure 15:
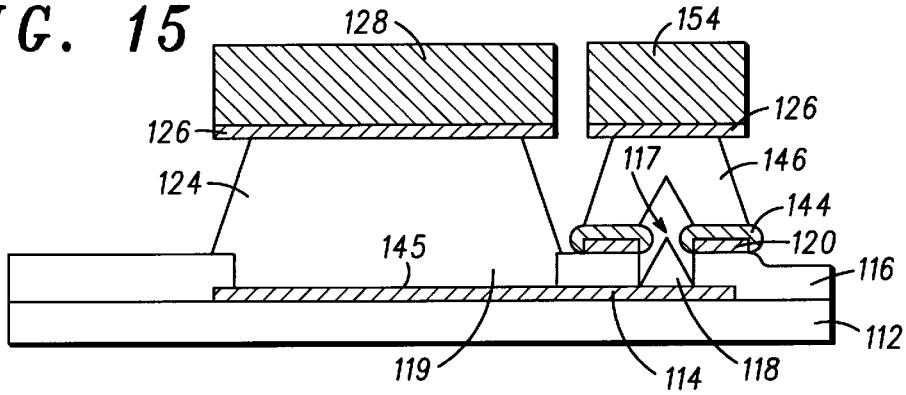
FIG. 15 is a cross-sectional view of another embodiment of an FED fabricated in accordance with the method of the invention.

FIG. 15 illustrates, in cross-section, another embodiment of FED 100 fabricated in accordance with the method of the invention. In the embodiment of FIG. 15, lift-off layer 144 is formed by electroplating the lift-off material onto gate electrode 120. A lift-off material suitable for use in the embodiment of FIG. 15 is a nickel-iron alloy. Electroplating of the lift-off material is achieved by selectively applying a potential to gate electrode 120. The potential is selected to plate the lift-off material from a plating solution.

Because the lift-off material is selectively deposited onto gate electrode 120, the size of the opening of base well 119 is not restricted to be less than an upper limit to prevent coating of bottom surface 145 of base well 119. Thus, base well 119 can be made relatively large, and it is possible to include just one base well, as illustrated in the embodiment of FIG. 15.

Figure 16:
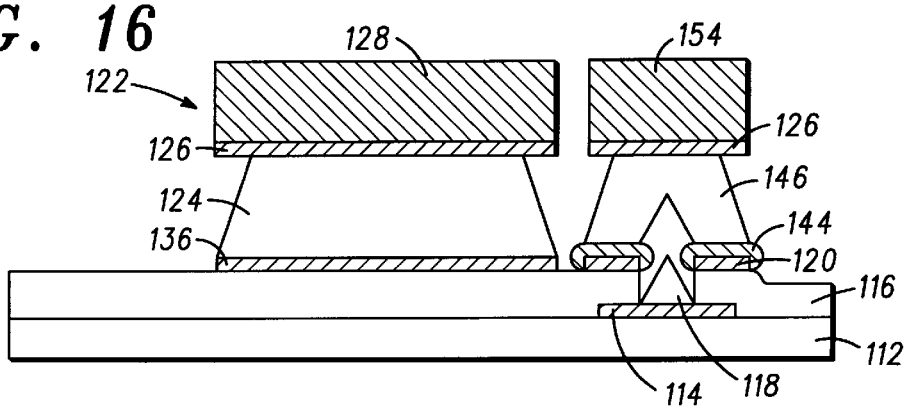
FIG. 16 is a cross-sectional view of yet another embodiment of an FED fabricated in accordance with the method of the invention.

FIG. 16 illustrates, in cross-section, yet another embodiment of FED 100 fabricated in accordance with the method of the invention. The fabrication of the embodiment of FIG. 16 also includes the step of electroplating onto gate electrode 120 to form lift-off layer 144. However, the embodiment of FIG. 16, omits base wells 119. Rather, electroplated structure 122 is formed on dielectric layer 116. Furthermore, the embodiment of FIG. 16 does not require the transition from a collimated to uncollimated vapor deposition of the emissive material. Emitter material layer 146 can be deposited using only a collimated vapor deposition.

The embodiment of FIG. 16 further includes base electrode 136. In the embodiment of FIG. 16, base electrode 136 is positioned between dielectric layer 116 and base 124. Base electrode 136 allows independent control of the potential at electroplated structure 122. In the embodiment of FIG. 16, cathode 114 does not extend beneath electroplated structure 122.

In summary, the invention is for an FED having an electroplated structure positioned adjacent to an electron emitter. The electroplated structure of the invention can be used to focus an emitted electron beam or to support a spacer. A method for fabricating an FED in accordance with the invention provides protection of the electron emitter during the steps for making the electroplated structure.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

We claim:

1. A field emission device comprising:

a substrate;

a dielectric layer disposed on the substrate and defining an emitter well;

an electron emitter formed of an emissive material and disposed within the emitter well;

a base formed of the emissive material and disposed proximate to the electron emitter and overlying the substrate;

an electroplating electrode disposed on the base; and an electroplated layer disposed on the electroplating electrode.

2. The field emission device as claimed in claim 1, wherein the emissive material of the electron emitter comprises molybdenum.

3. The field emission device as claimed in claim 1, wherein the electroplated layer comprises nickel.

4. The field emission device as claimed in claim 1, wherein the dielectric layer further defines a base well, and wherein the base is partially disposed in the base well.

5. The field emission device as claimed in claim 4, wherein the base well has an opening, wherein the emitter well has an opening, and wherein the opening of the base well is larger than the opening of the emitter well.

6. The field emission device as claimed in claim 1, further comprising a cathode disposed on the substrate, and wherein the electron emitter and the base are connected to the cathode.

7. The field emission device as claimed in claim 1, further comprising a cathode disposed on the substrate, and further comprising a base electrode disposed on the substrate, and wherein the electron emitter is connected to the cathode, and wherein the base is connected to the base electrode.

8. The field emission device as claimed in claim 1, further comprising a cathode disposed on the substrate, and further comprising a base electrode disposed on the dielectric layer, and wherein the electron emitter is connected to the cathode, and wherein the base is connected to the base electrode.

9. The field emission device as claimed in claim 1, further including an anode spaced apart from the electroplated layer, and further including a spacer interposed between the electroplated layer and the anode.

10. The field emission device as claimed in claim 9, further including a bonding layer interposed between the space and the electroplated layer.

* * * * *